US006383447B1

(12) United States Patent
Nakata et al.

(10) Patent No.: US 6,383,447 B1
(45) Date of Patent: May 7, 2002

(54) METHOD OF MANUFACTURING HELICAL GEARS BY COMPACTING POWDER MATERIALS

(75) Inventors: Toyoshige Nakata; Tadaaki Shimada; Tatsuhiro Iio; Toshimasa Fujita; Toshimi Ikeda, all of Kumamoto (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/610,474

(22) Filed: Jul. 5, 2000

(30) Foreign Application Priority Data

Jul. 5, 1999 (JP) ..... 11-189893

(51) Int. Cl.[7] ..... B22F 3/02
(52) U.S. Cl. ..... 419/66; 419/38; 425/78
(58) Field of Search ..... 419/38, 66; 425/78

(56) References Cited

FOREIGN PATENT DOCUMENTS

JP 11058087 3/1999

*Primary Examiner*—Daniel J. Jenkins
(74) *Attorney, Agent, or Firm*—Birch, Stewart, Kolasch & Birch, LLP

(57) ABSTRACT

An intermediary die 10 is provided with inner circumferential helical teeth r, a lower punch 7 is provided with outer circumferential helical teeth p, and an upper punch 8 is provided with outer circumferential helical teeth q, respectively. When the intermediary die 10, the lower punch 7 and the upper punch 8 all engage to manufacture helical gears by compacting powdered materials, lateral displacement (phase displacement) of a phase guide 11 which is adapted to engage with the upper outer punch 8*a*, is forcibly corrected to allow it to return to its original position, from the time when the load of the upper outer punch 8*a* is reduced to when the intermediary die 10 is released. There is also provided an escape surface on the pressing surface of the upper outer punch 8*a*. The escape surface is designed to reduce the slide contact force developed on a compacted product Ga when the upper outer punch 8*a* and the compacted product Ga are respectively displaced in a lateral direction.

13 Claims, 7 Drawing Sheets

(a)

(b)

(a)

(b)

METHOD OF MANUFACTURING HELICAL GEARS BY COMPACTING POWDER MATERIALS

BACKGROUND OF THE INVENTION

1. Field of the Invention

The present invention relates to the art of powder metallurgy, and more particularly to a method of manufacturing helical gears by compacting powdered materials which can prevent cracks or the like from being formed during the compacting process.

2. Description of the Prior Art

Hitherto, as an art of manufacturing helical gears as sintered products by compacting powdered materials, for example, there has been known the technology as disclosed in Japanese Patent Unexamined Publication No.H11-58087.

According to this technology, upper and lower punches respectively provided with outer circumferential helical teeth are arranged to engage with a floating die (an intermediary die) which is provided with inner circumferential helical teeth, wherein powdered materials are filled between the upper and lower punches. The upper punch is now moved downward to apply pressure to allow the powdered materials to be compacted. Then, the floating die is moved downward while holding the compacted product, with a predetermined holding power, between the upper and lower punches and is finally released from the compacted product.

In order to smoothly engage the outer circumferential helical teeth of the upper punch with the inner circumferential helical teeth of the floating die, the outer circumferential helical teeth of the upper punch are adapted to engage with inner circumferential helical teeth of a phase guide for phase adjustment.

In such a method of manufacturing helical gears by compacting powdered materials as described above, when a helix angle of the helical teeth is deep or the teeth profile is thin, there is an inconvenience that cracks will be caused in a part of the teeth, especially when the floating die, which has held the periphery of the compacted product in position, is moved downward after powdered materials have been compacted and released from the compacted product.

SUMMARY OF THE INVENTION

It is, therefore, an object of the present invention to prevent cracks from being caused especially when an intermediary die, which has held the periphery of a compacted product in position, is released, upon compacting powder materials.

To accomplish the above-mentioned object, according to the present invention, a method of manufacturing helical gears by compacting powdered materials comprises the steps of engaging an intermediary die provided with inner circumferential helical teeth with a lower punch provided with outer circumferential helical teeth, filling the powdered materials into a concave area formed by the lower punch and the intermediary die, moving an upper punch which is provided with outer circumferential helical teeth downward along a phase guide to engage with the intermediary die, wherein pressure is applied to the powdered materials to compact them, holding a compacted product with a predetermined holding power between the upper and lower punches, then releasing the intermediary die downward from the compacted product, wherein lateral displacement which is caused on the phase guide when the intermediary die is released, is forcibly corrected to allow the guide to return to its original position.

As a result of investigating the crack-generating mechanism, inventors of the present invention found that the cracks were caused by prizing of the upper surface of the compacted product by the upper punch when the intermediary die which holds the periphery of a compacted product in position is released while the compacted product is pressed with a predetermined holding power by the upper punch.

Namely, the upper punch is arranged to apply a pressure of about 420 tons when the powdered materials are compacted, but since the upper punch corresponding to a part of the helical teeth inclines relative to its vertical direction, it applies lateral load on a part of the intermediary die. After the powder materials are compacted, when the pressure from the upper punch is reduced to provide a holding power of about 4 tons, and the intermediary die is released while holding the compacted product, both the compacted product, held by the intermediary die in position until then, and the upper punch are now kept free. As a result, relative lateral displacement is caused between the upper punch and the compacted product to produce slide contact force with respect to the contacting portions therebetween. With this slide contact force, it is thought that large prizing force is developed on the upper surface of the compacted product to cause the cracks.

One the other hand, as described above, the upper punch is guided by a phase adjustment guide when it engages with the inner circumferential teeth of the intermediary die. Thus, when the upper punch applies a pressure of about 420 tons, it is considered that this phase guide will also cause lateral displacement (phase displacement) therein. Relative displacement, which is caused between the upper punch and the compacted product when the intermediary die is released, is also caused by this lateral displacement (phase displacement) of this phase guide, which is one of the main causes of the cracks.

Thus, by forcibly correcting the lateral displacement (phase displacement) which occurs at the phase guide when the intermediary die is released, the upper punch is positioned to return to its original position so that the prizing force developed on the compacted product can be reduced.

Herein, a concrete means for correcting the lateral displacement of the phase guide may be freely chosen, but it is possible to use a correcting means such as wedge action and multiple action.

In another aspect of the present invention, a method of manufacturing helical gears by compacting powdered materials comprises the steps of engaging an intermediary die provided with inner circumferential helical teeth with a lower punch provided with outer circumferential helical teeth; filling powdered materials into a concave area which is formed by the lower punch and the intermediary die; moving the upper punch provided with outer circumferential helical teeth downward along a phase guide so as to engage with the intermediary die, wherein the powdered materials are compacted by applying pressing load; holding the compacted product, with a predetermined holding power, between the upper and lower punches; then releasing the intermediary die downward from the compacted product, wherein the upper punch is provided, at its pressing surface, with an escape surface which serves to reduce slide contact force of the upper punch produced with respect to the compacted product when the intermediary die is released and relative lateral displacement is caused to occur between the upper punch and the compacted product.

Namely, the pressing surface of the conventional upper punch is formed flat and when the relative lateral displacement is caused to occur between the compacted product and the upper punch, this corresponds with the direction of the contact surface and is greatly influenced by the slide contact force. Therefore, if the pressing surface of the upper punch is provided with the escape surface which inclines in such a direction that both contact surfaces part when the relative lateral displacement occurs, it is possible to reduce the slide contact force of the upper punch against the compacted product.

In still another aspect of the present invention, the method of correcting the lateral displacement of the phase guide and the escape surface of the upper punch as described above are combined.

With this combination, it is possible to effectively prevent the prizing.

The above and other objects, features and advantages of the present invention will become more apparent from the following description when taken in conjunction with the accompanying drawings.

DETAILED DESCRIPTION OF THE PREFERRED EMBODIMENTS

The preferred embodiments of the present invention will be described hereunder with reference to the accompanying drawings.

Figure 1:
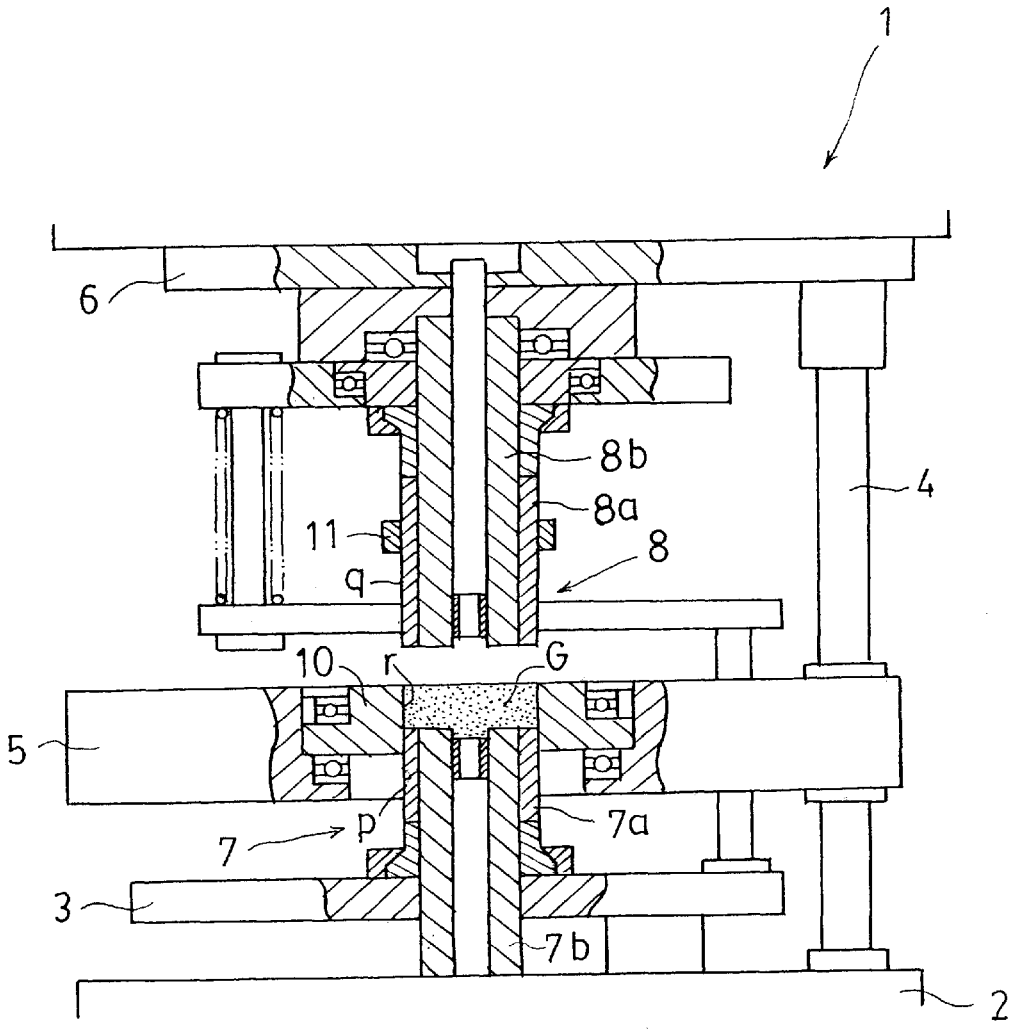
FIG. 1 is an explanatory view for explaining a structural outline of an apparatus for manufacturing helical gears by compacting powdered materials.
Figure 2:
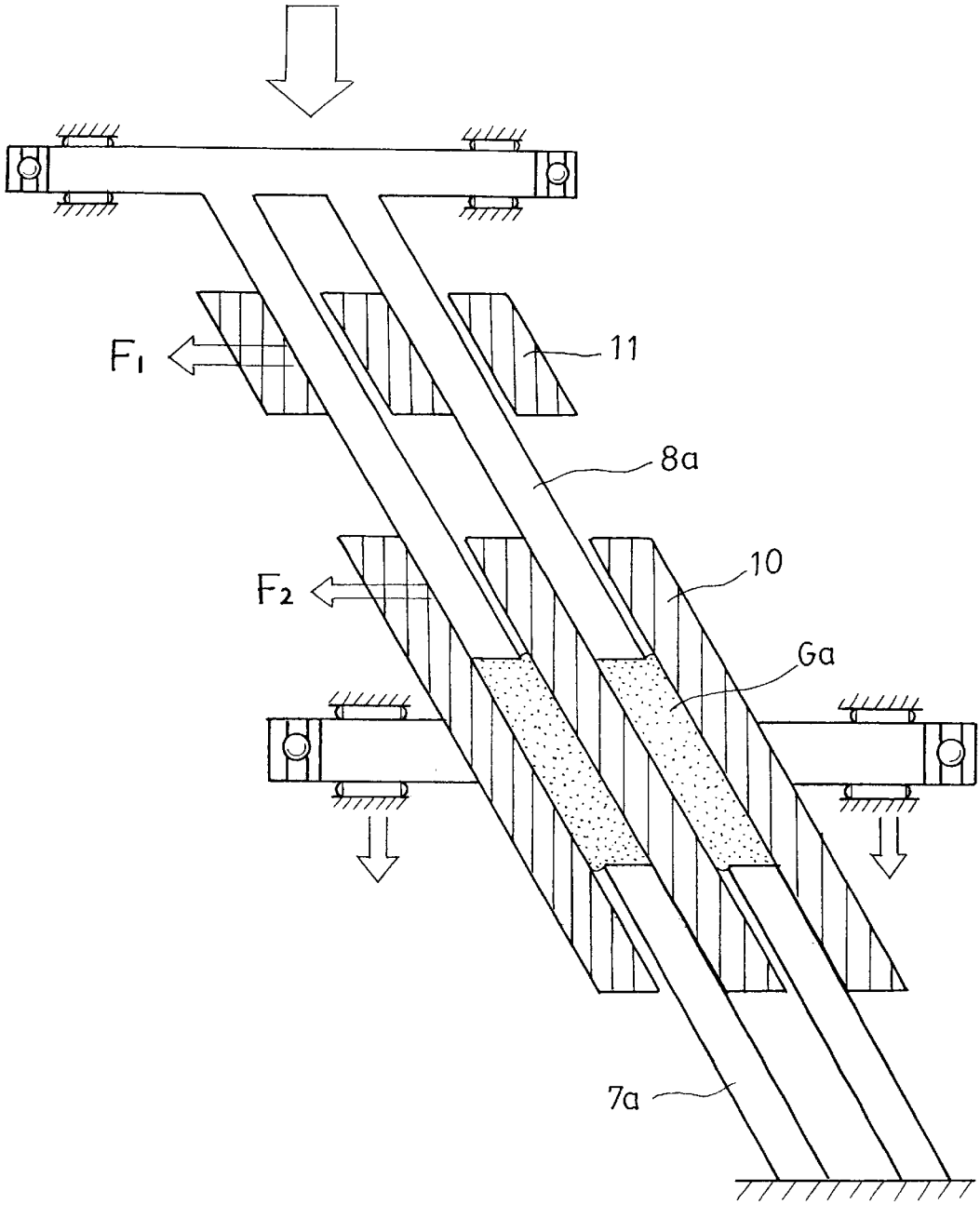
FIG. 2 is an explanatory view for explaining the load applied to teeth portions, as seen from the front direction thereof.
Figure 3:
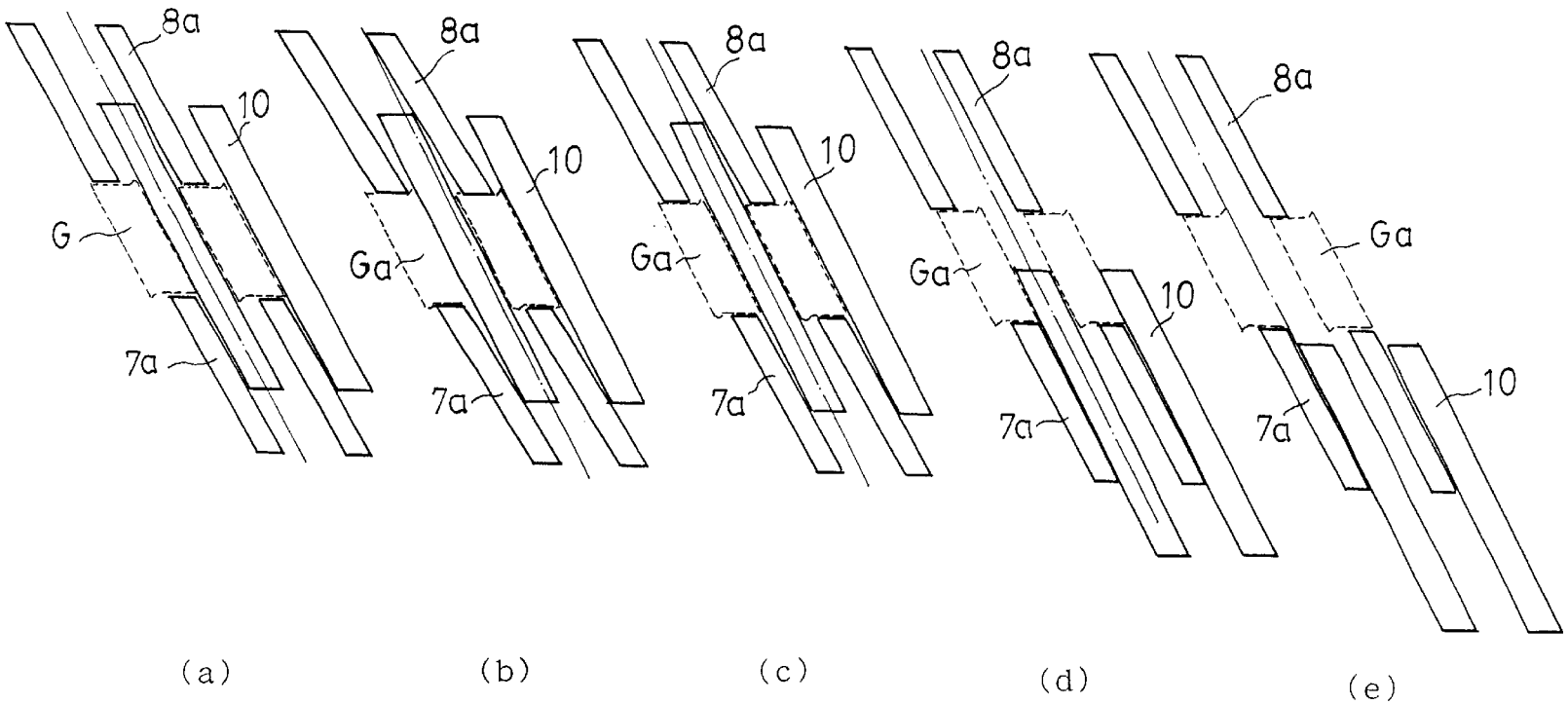
FIG. 3 is an explanatory view for showing the relation between an upper punch and a compacted product in time sequence.
Figure 4:
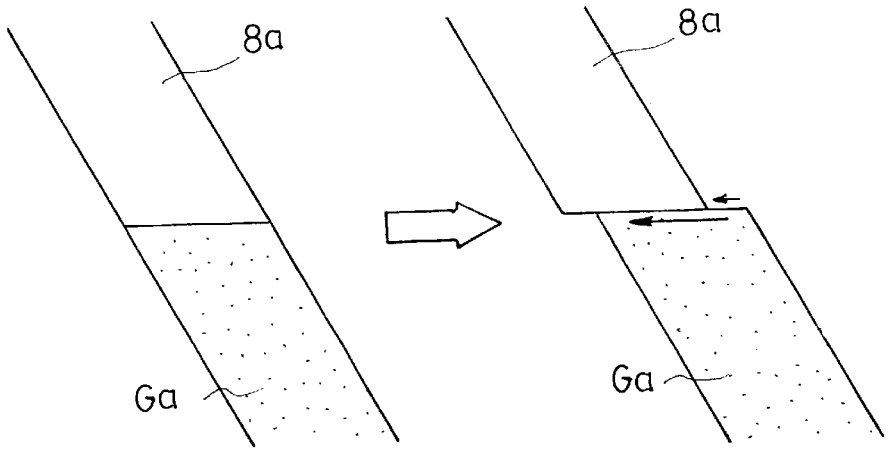
FIG. 4 is an explanatory view for explaining the cause of crack generation.
Figure 4:
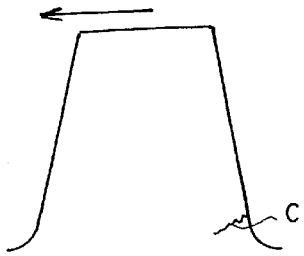
Figure 5:
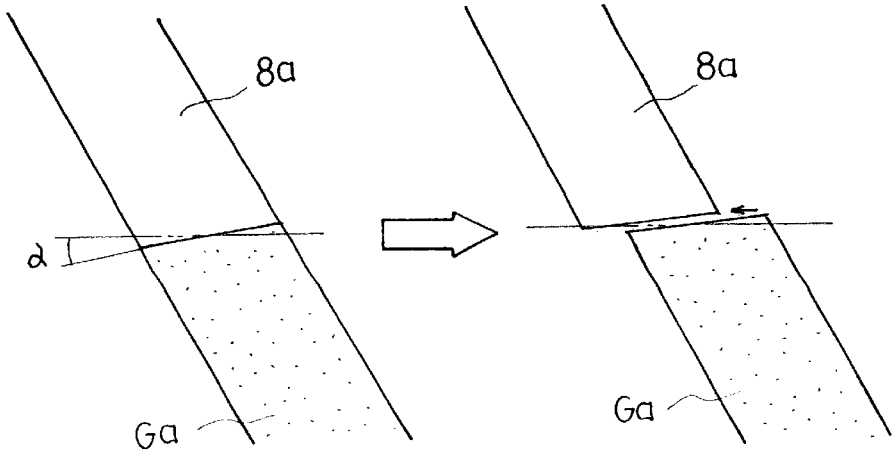
FIG. 5 is an action view when an escape surface is provided on the upper punch for prize prevention.
Figure 6:
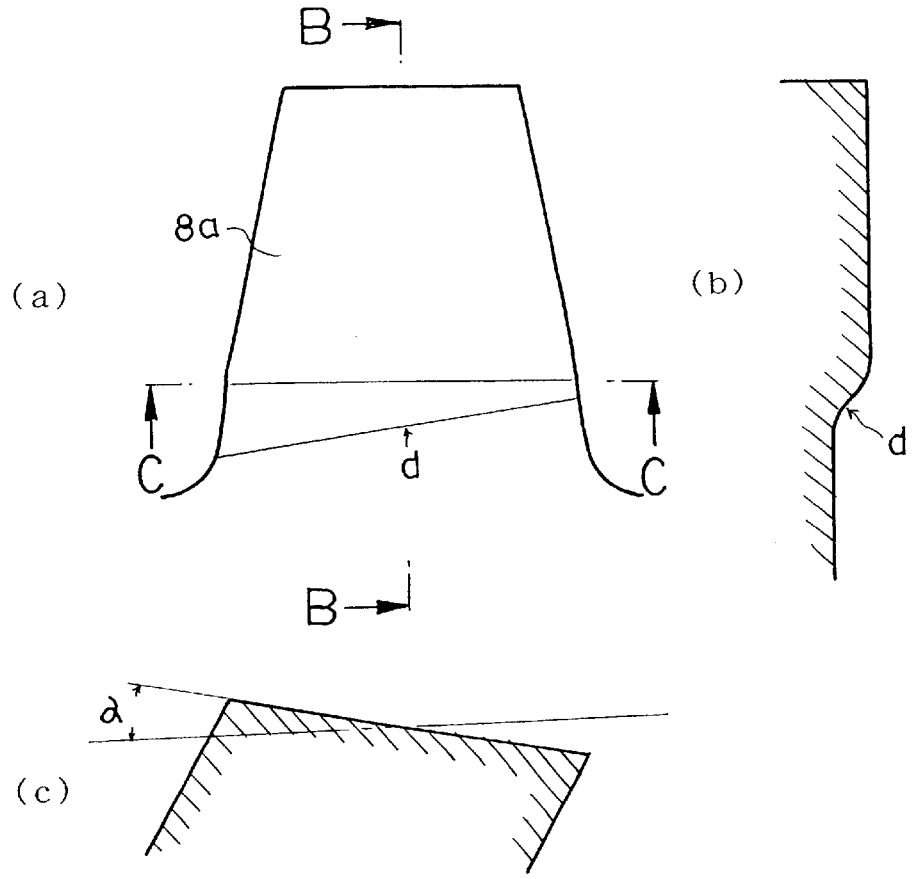
FIG. 6 are explanatory views of the end shape of the upper punch, in which FIG. 6(*a*) is a plan view, (*b*) is a cross-sectional view taken along the line B—B of (*a*), and (*c*) is a cross-sectional view taken along the line C—C of (*a*)
Figure 7:
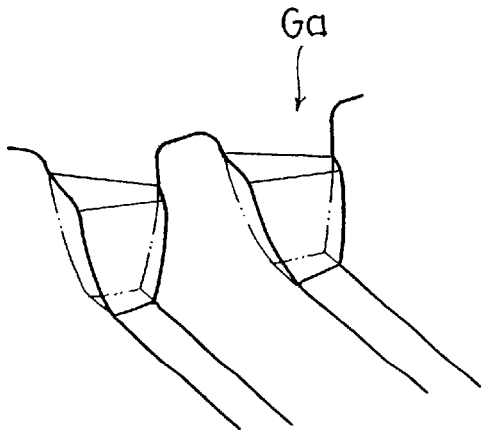
FIG. 7 is an explanatory view of the end shape of the compacted teeth.
Figure 8:
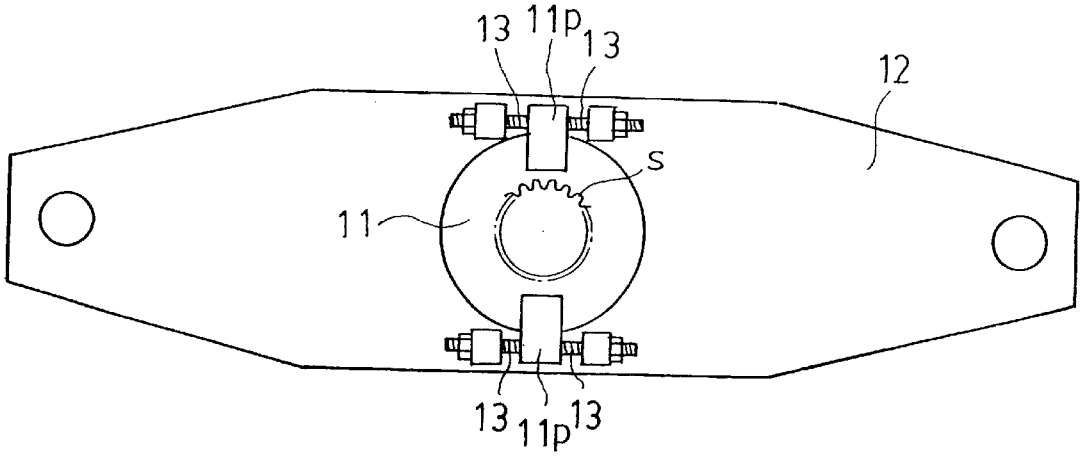
FIG. 8 is a plan view of a conventional phase guide.
Figure 9:
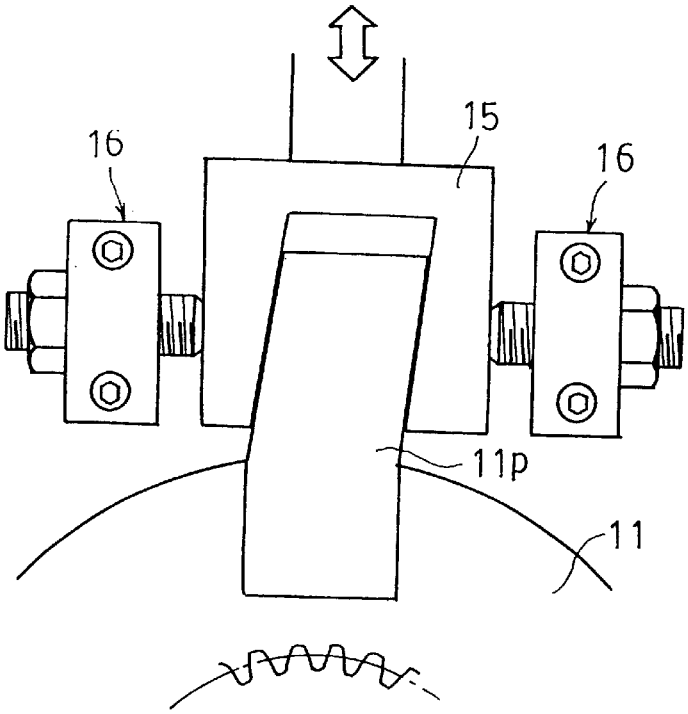
FIG. 9 is an explanatory view of a structural example for returning a phase guide through the intermediary of wedge motion.
Figure 10:
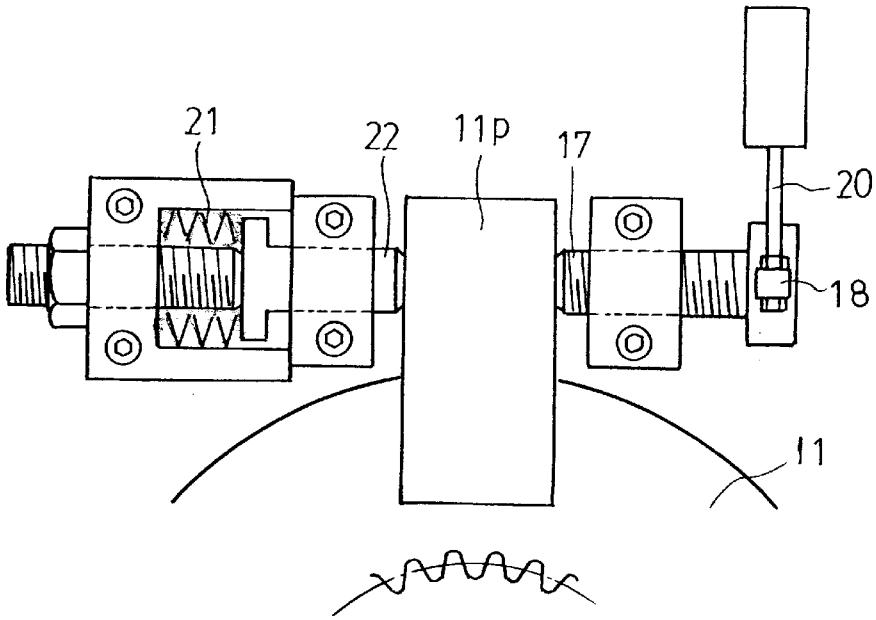
FIG. 10 are explanatory views of structural examples for returning the phase guide through the intermediary of screw motion, wherein FIG. 10(*a*) is a plan view and (*b*) is a side view.
Figure 10:
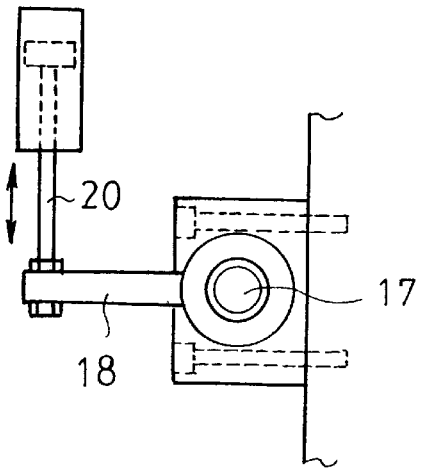

FIG. 1 is an explanatory view for explaining a structural outline of an apparatus for manufacturing helical gears by compacting powdered materials and FIG. 2 is an explanatory view for explaining the load which is applied to the teeth portions. FIGS. 3 and 4 are explanatory views for explaining the reason why cracks are caused in the teeth. FIG. 5 are action views in which an upper outer punch is provided with an escape surface for prize prevention. FIG. 6 is an explanatory view of the end shape of the upper punch and FIG. 7 is an explanatory view of the end shape of compacted teeth. FIGS. 8 through 10 are explanatory views of various kinds of structural examples of a phase guide.

The method of manufacturing helical gears by compacting powdered materials according to the present invention is applied to a compacting method in a powdered materials compacting apparatus 1 as shown in FIG. 1. The structural outline of this compacting apparatus 1 will now be explained hereunder.

The compacting apparatus 1 comprises a lower plate 3 fixedly secured to a base 2, an intermediary plate 5 slidably mounted on a guide post 4 which is arranged to stand on the base 2, and an upper plate 6. The upper plate 6 is supported to be capable of moving up and down along the guide post 4 through the intermediary of a pressing mechanism (not shown). The intermediary plate 5 is floatably supported by a floating mechanism (not shown).

A lower punch 7 comprising a lower inner punch 7*b* and a lower outer punch 7*a* is fixedly secured to the lower plate 3 and outer circumferential helical teeth pare formed on the outer circumference of the lower outer punch 7*a*.

An upper punch 6 comprising an upper inner punch 8*b* and an upper outer punch 8*a* is provided on the upper plate 6. The upper outer punch 8*a* is rotatably mounted on the circumference of the upper inner punch 8*b* and outer circumferential helical teeth q are formed on the outer circumference of the upper outer punch 8*a*.

The intermediary plate 5 is provided with an intermediary die 10 which is rotatably supported around the central axis thereof. On the inner circumference of the intermediary die 10 is formed a plurality of inner circumferential helical teeth r.

These inner circumferential helical teeth r of the intermediary die 10 are usually set to engage with the outer circumferential helical teeth p of the lower outer punch 7*a*, the upper portion of which is formed as a concave area for filling powder materials therein.

Also, when the upper punch 8 moves downward, the outer circumferential helical teeth q of the upper outer punch 8*a* are arranged to be capable of engaging with the inner circumferential helical teeth r of the intermediary die 10. A phase guide 11 for adjusting a phase of the upper outer punch 8*a* thus engages with the outer circumferential helical teeth q of the upper outer punch 8*a*.

This phase guide 11 is, as shown in FIG. 8, for example, provided with a plurality of inner circumferential helical teeth s which are adapted to engage with the outer circumferential helical teeth q of the upper outer punch 8*a*, and is rotatably mounted relative to a guide plate 12. As described hereunder, guide pieces 11*p* integrally formed with the phase guide 11 are held locked by phase adjusting bolts 13.

In such a powdered materials compacting apparatus 1, as shown in FIG. 1, the concave area on the lower punch 7 is filled with powdered materials G. The upper punch 8 is moved downward to engage the outer circumferential helical teeth q of the upper outer punch 8*a* with the inner circumferential helical teeth r of the intermediary die 10. When the upper punch 8 is further moved downward, the intermediary die 10 and the upper outer punch 8*a* axially rotate so as to avoid the interference of the teeth. Then, when a load of about 420 tons is applied to the upper punch 8 to complete the powder compacting process, the load applied to the upper punch 8 is now reduced to about 4 tons so as to hold the compacted product in position. The intermediary plate is further moved downward to release the intermediary die 10 from the compacted product, after which the compacted product is removed therefrom.

In such a compacting method, the helix angle of the helical teeth of the compacted gears may be formed deep or the teeth profile may be thin. Cracks will be easily caused in a part of the teeth when the intermediary die 10 is released after a load of about 420 tons is applied to the powdered materials for compacting process.

The crack generating mechanism will now be explained hereunder with reference to FIGS. 2 and 4.

As shown in FIG. 2, when a load of about 420 tons is applied to the powdered materials G kept on the lower outer punch 7*a* by the upper outer punch 8*a*, the phase guide 11 is subject to a lateral force $F_1$ under the influence of the helix angle. As a result, the phase of the phase guide 11 is displaced to allow the upper outer punch 8*a* to contact and put pressure on the side of the intermediary die 10, whereby a lateral force $F_2$ is developed on the intermediary die 10.

Herein, the relation between the upper outer punch 8*a*, the compacted product Ga and the intermediary die 10 while compacting powdered materials is shown in time sequence in FIG. 3. In FIG. 3(*a*), after starting to compact the powdered materials, a load of about 420 tons is first exerted by the upper outer punch 8*a*. Then, as shown in FIG. 3(*b*), the upper outer punch 8*a* contacts and puts pressure on the side of the intermediary die 10 so as to be supported by the intermediary die 10.

Then, after the powder compacting process is completed, the load on the upper outer punch 8*a* is reduced to about 4 tons to shift to the state of FIG. 3(*c*). The upper outer punch 8*a* still contacts and puts pressure on the side of the intermediary side 10 and the intermediary die 10 is subject to lateral force.

Subsequently, holding the compacted product Ga with a holding power of about 4 tons, the intermediary die 10 begins to move downward as shown in FIG. 3(*d*).

As shown in FIG. 3(*e*), the intermediary die 10 departs from the upper outer punch 8*a*. When it moves further downward to be disengaged from the compacted product Ga, the upper outer punch 8*a* and the compacted product Ga are relatively displaced in a lateral direction. As shown in FIG. 4(*a*), the upper surface of the compacted product Ga is dragged by the pressing surface of the upper outer punch 8*a* and as a result, a crack c is caused in a part of the teeth as shown in FIG. 4(*b*).

Namely, when the load is applied by the upper outer punch 8*a*, the phase guide 11 is subject to the lateral force to cause the displacement of the phase. Subsequently, when the intermediary die 10 is released from engagement with the compacted product Ga, the upper outer punch 8*a* and the compacted product Ga cause relative displacement in the lateral direction. As a result, the upper surface of the compacted product Ga is prized as if it were dragged by the outer punch 8*a*. This is considered to be the reason why crack c is caused.

To make the above-mentioned crack generating mechanism clear and prevent such cracks from being caused, inventors of the present invention conceived that the position of the upper outer punch 8*a* should be forcibly returned to its original position when the intermediary die is released, or the surface of the compacted product Ga should not be dragged even when respective displacement is caused in the lateral direction between the compacted product Ga and the upper outer punch 8*a*. The present invention was thus completed.

FIGS. 5 through 7 show a structure in which the end shape of the upper outer punch 8*a* is modified so that the upper surface of the compacted product Ga is not dragged even when relative displacement is caused in the lateral direction between the compacted product Ga and the upper outer punch 8*a*.

According to this structure, there is provided an escape surface with an angle of inclination α on the pressing surface of the upper outer punch 8*a* so that the upper surface of the compacted product Ga can not be dragged even if relative lateral displacement is caused between the compacted product Ga and the upper outer punch 8*a* when the intermediary die 10 is released from the compacted product Ga.

Namely, as shown in FIG. 5, this escape surface is formed as a surface which inclines in such a direction that the upper outer punch 8*a* and the compacted product Ga part when lateral displacement is caused. In the preferred embodiment, the angle of inclination α is set at 8° and the concrete end surface of the upper outer punch 8*a* is shown in FIG. 6.

FIG. 6(*a*) is a plan view of the pressing surface of the upper outer punch 8*a*, FIG. 6(*b*) is a cross-sectional view taken along the line B—B of (*a*), and FIG. 6(*c*) is a cross-sectional view taken along the line C—C of (*a*).

This escape surface is formed to extend from a dedendum to an addendum. Since the powdered materials are compacted by such an upper outer punch 8*a* as described above, the teeth profile of the compacted product Ga is formed in a shape without the area shown by a broken line, that is, in a shape as shown by a solid line in FIG. 7.

A difference din level (stepped portion) is formed between the escape surface area and the rest, but this difference d in level is also rounded to avoid stress concentration.

With this escape surface, such inconvenience in that the upper surface of the compacted product Ga is dragged by the pressing surface of the upper outer punch 8*a* is controlled, even if respective lateral displacement is caused between the upper outer punch 8*a* and the compacted product Ga when the intermediary die 10 is released from engagement with the compacted product Ga.

Next, when the load is released after the powdered materials are compacted, the upper outer punch 8*a* is forcibly returned to its original position. One example of such concrete structures will now be explained with reference to FIGS. 8 through 10.

FIG. 8 is an explanatory view of a conventional phase guide. FIG. 9 is an explanatory view of a first structural example and FIG. 10 is an explanatory view of a second structural example according to the present invention.

The conventional phase guide 11 as shown in FIG. 8 is rotatably mounted on a guide plate 12 as described above. Guide pieces 11*p* located at two locations fixedly secured to this phase guide 11 are respectively set in position from both sides by a pair of phase adjustment bolts 13 and locked.

Inner circumferential helical teeth s of the phase guide 11 are arranged to engage with outer circumferential helical teeth q of the upper outer punch 8*a* so that the phase between the outer circumferential helical teeth q of the upper outer punch 8*a* and the inner circumferential helical teeth r of the intermediary die 10 can be adjusted. This phase adjustment is conducted by screwing and unscrewing the phase adjustment bolts 13. However, in such a locking mechanism, the phase guide 11 is subject to the lateral force $F_1$ from the upper outer punch 8*a* during the compacting of powder materials so as to cause the phase displacement. It is therefore obvious from the above-mentioned description that lateral displacement (phase displacement) will be caused as the intermediary die 10 is released.

In order to allow the upper outer punch 8*a* to forcibly return to its original position when the intermediary die 10 is released, in the structural example as shown in FIG. 9, a projecting portion of the guide piece 11*p* is inclined to engage with a wedge member 15. This wedge member 15 is moved in the direction indicated by an arrow by a driving source (not shown) to allow the phase of the phase guide 11 to change.

Provided on both sides of the wedge member 15 are a pair of receiving members 16 which serve to guide the movement of the wedge member 15 and to reinforce the strength thereof when a lateral load is applied thereto.

When the load is applied, for example, to the upper outer punch 8*a*, the load in the lateral direction is applied toward the right receiving member 16 in FIG. 9. In this case, the wedge member 15 is moved back by a driving source (not shown), from the time when the load of the upper outer punch 8*a* is reduced, to when the intermediary die 10 is released. The guide piece lip is then moved in the left direction through the intermediary of wedge action so that the upper outer punch 8*a* can be forcibly returned to its original position.

With this arrangement, it is possible to control the generation of respective lateral displacement between the upper outer punch 8*a* and the compacted product Ga when the intermediary die 10 is released from engagement with the compacted product Ga.

FIG. 10 is another structural example where the phase of the upper outer punch 8*a* is returned to its original position through the intermediary of screw motion.

In this case, a screw member 17 is provided on one side and a pressing member 22 on the other side. These members 17 and 22 are adapted to serve as receiving members for receiving lateral load to be applied through a guide piece 11*p* when the load is applied to the upper outer punch 8*a*. The screw member 17 is connected, at its base side, with the tip of a cylinder rod 20 through an arm 18. Forward and backward movement of the cylinder rod 20 allows the screw member 17 to go ahead and back, while the pressing member 22 biased by a coned disc spring 21 is arranged to abut the guide piece 11*p*.

The load applied to the upper outer punch 8*a* is received by the screw member 17. From the time when the load of the upper outer punch 8*a* is reduced to when the intermediary die 10 is released, the screw member 17 is moved forward by moving the cylinder rod 20 so as to move the guide piece lip to the left, thereby forcibly returning the phase of the upper outer punch 8*a* to its original position.

It is therefore possible to control the respective lateral displacement caused between the upper outer punch 8*a* and the compacted product Ga and also to effectively prevent the cracks from being caused.

As described above, according to the present invention, the escape surface on the pressing surface of the upper outer punch 8*a* and the forcibly returning mechanism of the phase guide 11 (the upper outer punch 8*a*) are provided. It is therefore possible to make full use of the combination of these so as to obtain both effects and to effectively prevent cracks from being caused.

Although certain preferred embodiments of the present invention have been shown and described in detail, the invention is not limited thereto but may be otherwise variously embodied within the scope of the appended claims. It is also to be understood that any method of manufacturing helical gears by compacting the powdered materials employing substantially the same construction and performing the same function to obtain the same result, therefore, will fall within the same technical scope as the claimed invention.

For example, either one of the escape surface of the pressing surface of the upper outer punch 8*a* or the mechanism for forcibly returning the upper outer punch 8*a* may be adopted. It is also to be noted that the concrete mechanism for forcibly returning the upper outer punch 8*a* is just an example and may be modified to utilize other methods.

As described above, the method of manufacturing helical gears by compacting the powdered materials according to the present invention is characterized in that the lateral displacement which is caused on the phase guide, is forcibly corrected to allow it to return to its original position, when the intermediary die is released after pressure is applied by the upper punch to compact the powder materials. It is therefore possible to reduce the prizing force imposed on the compacted product and to control the possible generation of cracks.

Further, the pressing surface of the upper punch is provided with an escape surface which serves to reduce the slide contact force of the upper punch developed on the compacted product when relative lateral displacement is caused between the upper punch and the compacted product. It is therefore possible to reduce the prizing force against the compacted product and also to control the generation of cracks.

Still further, it is also possible to control the generation of cracks more effectively if both the mechanism for forcibly returning the upper punch and the provision of the escape surface on the upper punch are combined.

What is claimed is:

1. A method of manufacturing helical gears by compacting powdered materials comprising the steps of:

engaging an intermediary die, which is provided with inner circumferential helical teeth, with a lower punch which is provided with outer circumferential helical teeth;

filling the powdered materials into a concave area formed by the lower punch and the intermediary die, moving an upper punch, which is provided with outer circumferential helical teeth, downward along a phase guide to engage with the intermediary die, wherein the powdered materials are compacted by applying pressure;

holding a compacted product with a predetermined holding power by the upper and lower punches, and releasing the intermediary die downward from the compacted product;

wherein lateral displacement which is caused on the phase guide when the intermediary die is released, is forcibly corrected by returning a phase of the upper outer punch to its original position by moving a wedge member to allow a phase guide to change until the intermediary die is released.

2. A method of manufacturing helical gears by compacting powdered materials comprising the steps of:

engaging an intermediary die which is provided with inner circumferential helical teeth with a lower punch which is provided with outer circumferential helical teeth;

filling the powdered materials into a concave area formed by the lower punch and the intermediary die;

moving an upper punch which is provided with outer circumferential helical teeth, downward along a phase guide to engage with the intermediary die, wherein the powdered materials are compacted by applying pressure;

holding a compacted product with a predetermined holding power by the upper and lower punches, and releasing the intermediary die downward from the compacted product;

wherein the upper punch is formed, at its pressing surface, with an escape surface which serves to reduce the slide contact force of the upper punch developed with respect to the compacted product when the intermediary die is released and relative lateral displacement is caused between the upper punch and the compacted product.

3. A method of manufacturing helical gears by compacting powder materials comprising the steps of:

engaging an intermediary die, which is provided with inner circumferential helical teeth, with a lower punch which is provided with outer circumferential helical teeth;

filling the powdered materials into a concave area formed by the lower punch and the intermediary die;

moving an upper punch which is provided with outer circumferential helical teeth downward along a phase guide to engage with the intermediary die, wherein the powdered materials are compacted by applying pressure;

holding a compacted product with a predetermined holding power by the upper and lower punches; and releasing the intermediary die downward from the compacted product;

wherein lateral displacement which is caused on the phase guide when the intermediary die is released, is forcibly corrected to allow the guide to its original position; and wherein the upper punch is provided, at its pressing surface, with an escape surface which serves to reduce the slide contact force of the upper punch developed with respect to the compacted product when the intermediary die is released and relative lateral displacement is caused between the upper punch and the compacted product.

4. The method according to claim 1, further comprising the step of:

including a pair of receiving members which serve to guide the movement of the wedge member and to reinforce the strength thereof when a lateral load is applied.

5. The method according to claim 4, further comprises the step of:

moving the wedge member by a driving source.

6. The method according to claim 1, further comprising the step of:

forcibly returning a phase of the upper punch to its original position by moving a screw member forward by a cylinder rod until the intermediary die is released.

7. The method according to claim 6, further comprising the step of:

providing the screw member on one side of the guide and a pressing member on the other side.

8. The method according to claim 7, further comprising the step of:

allowing the screw member to go forward and back, while the pressing member is biased by a disc spring.

9. The method according to claim 1, further comprising the step of:

arranging the inner circumferential helical teeth of the phase guide to engage with the outer circumferential helical teeth of the upper outer punch so that the phase between the outer circumferential helical teeth of the upper outer punch and the inner circumferential helical teeth of the intermediary die can be adjusted.

10. The method according to claim 2, further comprising the step of:

providing the escape surface with an angle of inclination on the pressing surface of the upper outer punch.

11. The method according to claim 3, further comprising the step of:

providing the escape surface with an angle of inclination on the pressing surface of the upper outer punch.

12. The method according to claim 2, further comprising the step of:

forming a stepped portion between the escape surface and a rest.

13. The method according to claim 3, further comprising the step of:

forming a stepped portion between the escape surface and a rest.

* * * * *